United States Patent [19]

Sullivan et al.

[11] Patent Number: 5,018,472

[45] Date of Patent: May 28, 1991

[54] HORIZONTALLY MOVEABLE WEIGHT STABILIZING DEVICE

[75] Inventors: Michael J. Sullivan; Douglas G. Dussault, both of Oakdale; Daniel Dinsmore, Jr., East Lyme, all of Conn.

[73] Assignee: The United States of America as represented by the Secretary of the Navy, Washington, D.C.

[21] Appl. No.: 373,538

[22] Filed: Jun. 22, 1989

[51] Int. Cl.[5] ..... B63B 21/56

[52] U.S. Cl. ..... 114/244; 114/124

[58] Field of Search ..... 114/121, 122, 124, 125, 114/244, 254

[56] References Cited

U.S. PATENT DOCUMENTS 1,339,628 5/1920 Selah ..... 114/124
2,695,586 11/1954 Montrose-Oster ..... 114/124
3,967,573 7/1976 Charles et al. ..... 114/244
4,455,962 6/1984 Gongwer ..... 114/124

FOREIGN PATENT DOCUMENTS 309771 7/1933 Italy ..... 114/124

*Primary Examiner*—Sherman Basinger
*Assistant Examiner*—Stephen P. Avila
*Attorney, Agent, or Firm*—Michael J. McGowan; Prithvi C. Lall

[57] ABSTRACT

A stabilizing device for an underwater towed body includes a keel attached to the bottom surface of the towed body to provide for any major correction for its rolling motion. Any finer correction of the rolling motion of the towed body is accomplished by moving horizontally a trim weight housed inside the towed body. The horizontal movement of the trim weight is controlled by the power applied to the electric motor which is determined by the rolling motion sensor.

9 Claims, 1 Drawing Sheet

HORIZONTALLY MOVEABLE WEIGHT STABILIZING DEVICE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

Subject invention is related to underwater towed bodies and more particularly to an apparatus and method for stabilizing an underwater towed body by correcting for its rolling motion.

(2) Description of the Prior Art

Traditionally, an underwater towed body is stabilized against its rolling motion due to a tow cable torque by either; the correcting moment of a weight used as a keel, or by the use of ailerons controlled by a roll sensor. Usually, the tow cable used for a towed body is not torque balanced and a slip joint connection between the towed body and the tow cable is not considered desirable as a water tight slip joint is expensive, complex, and likely to contaminate the acoustic sensor signals which are sent up the tow cable. There is thus a need for a simple and effective way to correct for both coarse and fine rolling motions of the towed body due to the torque of the tow cable.

SUMMARY OF THE INVENTION

A stabilizing device to compensate for the rolling motion of a towed body according to the teachings of subject invention includes a keel attached to the bottom of the towed body for correcting its coarse rolling motion. A horizontally movable trim weight is positioned inside the towed body so as to provide correction for its fine rolling motion. Both the keel and the trim weight provide correcting torques to stabilize the towed body.

An object of subject invention to correct for rolling motion of a towed body.

Another object of subject invention is to provide means for correcting both coarse and fine rolling motion of the towed body.

Still another object of subject invention is to provide a simple and effective device for correcting coarse and fine rolling motions of the towed body simultaneously.

Other objects, advantages and novel features of the invention may become apparent from the following detailed description of the invention when considered in conjunction with the accompanying drawings wherein:

DESCRIPTION OF THE PREFERRED EMBODIMENT

Figure 1:
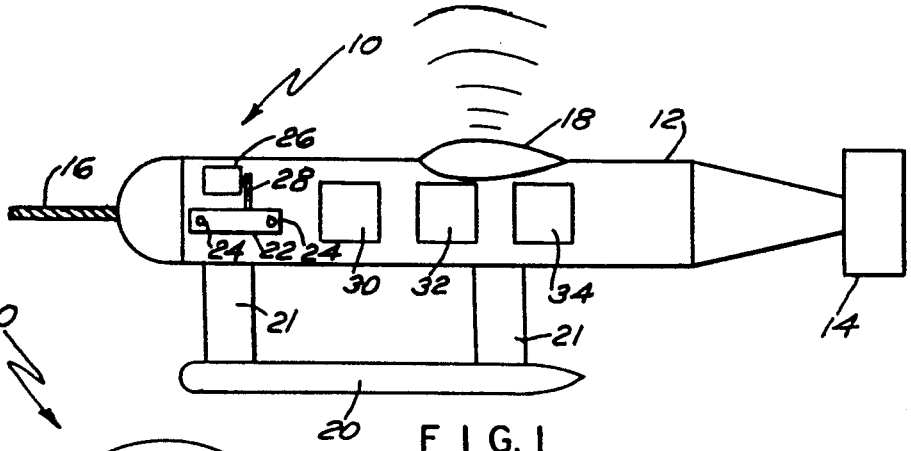
FIG. 1 is a block diagram of a towed body and the stabilizing device according to the teachings of subject invention.
Figure 4:
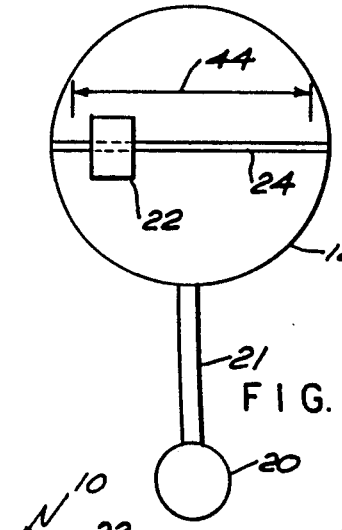
FIG. 4 is another partial cross sectional view to show the effect of horizontally moveable trim weight on the rolling motion of the towed body.
Figure 3:
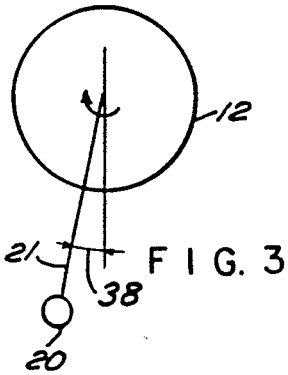
FIG. 3 is a partial cross sectional view to show the effect of the keel when the towed body experiences a rolling motion.
Figure 2:
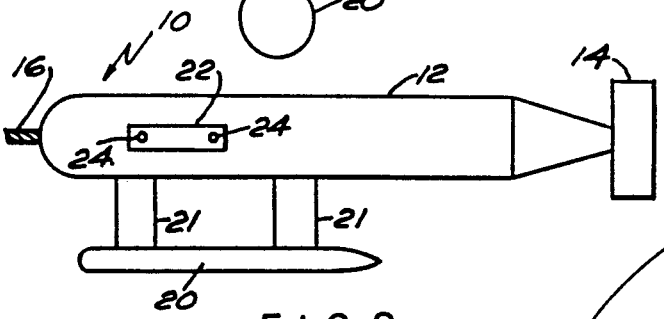
FIG. 2 is another schematic representation of the towed body and the stabilizing device.
Figure 5:
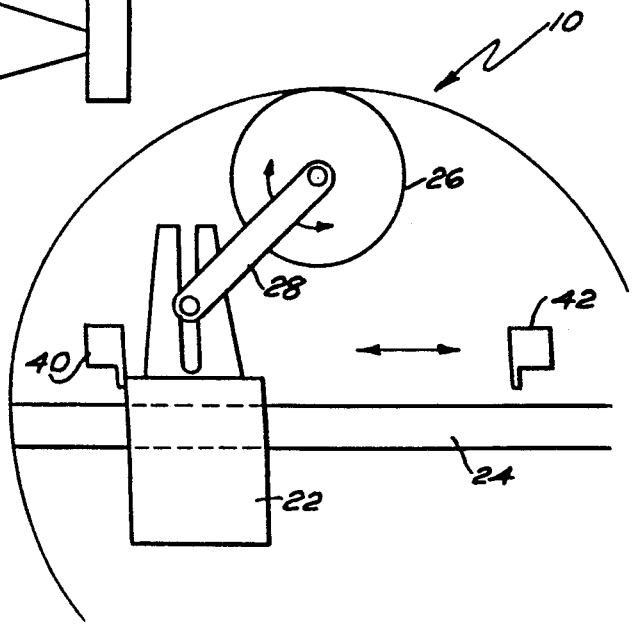
FIG. 5 is a schematic representation of the movement of the horizontally moveable trim weight for a final rolling motion correction.

Referring to the drawings wherein like reference characters designate identical or corresponding parts throughout the several figures and more particularly to FIG. 1 thereof, a stabilizing device 10 according to the teachings of subject invention is shown in a block diagram form. Towed body 12 has tail section 14 and is being towed by means of tow cable 16. An acoustical sensor 18 is secured to the top of the towed body so that it looks upward at the top of the towed body. A weight 20 is used as a keel for the towed body and is attached to it by using rigid support 21. It also has a trim weight 22 which is moveable laterally (i.e, horizontal direction) along guide bars 24. The lateral or horizontal motion of the trim weight 22 is controlled by electric motor 26 which is connected to the trim weight 22 by means of drive cam mechanism 28. The towed body also includes electronics module 30 and a roll-, pitch-, and depth-sensor 32 to monitor the various parameters of the towed body. It also has a control electronics package 34 which includes voltage regulator and generates timing signals for a transmitter and limit control signals for weight moving motor 26. FIG. 2 shows a side view of the towed body wherein keel 20 is shown to be attached to the bottom surface of the towed body by means of rigid support 21. FIG. 3 shows towed body 12 and keel 20 wherein the keel or weight 20 is displaced from the vertical position and makes a small angle 38 with the vertical line. This displacement of the keel or weight 20 because of the rolling motion of the towed body due to the tow cable 16 generates a torque which is given by the weight of the keel times the distance between the centers of gravity of towed body 12 and keel 20 multiplied by sine of the angle between the vertical and the position of rigid support 21 as shown is FIG. 3. FIG. 4 shows an end view of the towed body and the position of trim weight 22 as it is moved along rigid bars 24. FIG. 5 is a representation of the towed body 12 as trim weight 22 is moved horizontally to one extreme position by means of the trim weight motor 26. Further movement beyond the extreme position is restricted by limit switch 40. A similar limit switch 42 is provided to limit the horizontal position of the trim weight 22 in the opposite direction. Line 44 of FIG. 4 indicates the distance through which the trim weight 22 can move in the horizontal direction.

In operation, when rolling motion of the towed body is caused by the tow cable, the keel is displaced from its vertical position so that the line between the centers of gravity of the towed body 12 and keel 20 makes an angle with the vertical line, a restoring torque is provided by the keel or weight 20 which is given by weight of the keel times the lever arm, i.e., distance between centers of gravity of the towed body and the keel times the sine of the angle between 21 and the vertical position as shown in FIG. 3. Any fine control torque correction is provided by the displacement of the trim weight 22 along guide bars 24 as shown in FIGS. 4 and 5. The movement of trim weight 22 is accomplished by the electric motor 26 and cam drive 28 as shown in FIGS. 1, 4, and 5. The rolling position of the towed body is sensed by roll-, pitch-, and depth-sensor 32 and the power to the motor 26 is controlled by electronic package 30 and sensor 32. Electronic package 34 provides power for the sonar transducer which includes a transmitter and a receiver.

Briefly stated, a stabilizing device for a towed body to correct for the rolling motion caused by the torque of the towed cable includes a keel attached to the bottom surface of the towed body and a horizontally moveable trim weight housed in the towed body. The rolling motion of the towed body displaces the keel from the vertical position generating a corrective torque to compensate for its coarse rolling motion. Any finer correction is provided by a trim weight which is moved in the horizontal direction by means of a electric motor which receives its power as determined by a signal from the rolling motion sensor housed inside the towed body Note that because the keel has removed most of the rolling motion, the trim weight sliding along the guide rails 24 rigidly mounted perpendicularly to the keel, moves nearly horizontally, thereby resulting in almost maximum potential corrective moment for weight 22. It should be understood that the words used for the preferred embodiment described above are not to be construed as limitations but they should be considered as words of description.

Many modifications and variations are possible to practice subject inventive concept without deviating from the teachings of subject invention. For example, the shape and position of the keel can be varied. Furthermore, the design of the rolling motion sensor can also vary. It is therefore understood that within the scope of the appended claims, the invention may be practiced otherwise than specifically described.

What is claimed is:

1. A stabilizing device for a towed body towed by a tow cable against the rolling motion caused by an imbalanced torque in the tow cable, said stabilizing device includes:

means for sensing displacement due to rolling motion of said towed body;

a keel attached to said body at the bottom surface thereof for providing a coarse correction against the rolling motion of said towed body;

said towed body including a trim weight moveable along guide bars and controlled by an electric motor which is connected to the trim weight by a drive cam mechanism; and means for providing finer correction against the rolling motion to stabilize said towed body.

2. The stabilizing device of claim 1 wherein said means for providing finer correction includes a trim weight mounted along guide bars inside said towed body for providing a small counter torque to said towed body and thus provide said finer correction.

3. The stabilizing device of claim 2 wherein said trim weight is horizontally movable along said guide bars so as to generate a counter torque for providing finer correction to said towed body against the rolling motion thereof.

4. The stabilizing device of claim 3 which further includes a motor means for providing horizontal motion along said guide bars to said trim weight so as to generate a counter torque for providing said finer correction to said towed body against the rolling motion thereof.

5. The stabilizing device of claim 4 which further includes a rolling motion sensor for controlling the power to said motor means to generate a counter torque for providing said finer correction to said towed body against the rolling motion thereof.

6. The stabilizing device of claim 5 which further includes a pair of limit switches for providing an upper bound and a lower bound of counter torque by said trim weight.

7. The stabilizing device of claim 5 wherein said means for providing finer correction further includes electronic means for generating signals to provide a counter torque for providing finer counter torque to said towed body against the rolling motion thereof.

8. A method for stabilizing a body towed by means of a tow cable said method using a keel attached to the bottom surface of the towed body for coarse correction and a trim weight horizontally movable within limits provided by a pair of limit switches and proportional to the rolling motion of the towed body, by motor means which includes the steps of:

permitting said towed body to be counter torqued by said keel to provide coarse correction to the rolling motion of said towed body;

sensing the residual rolling motion of said towed body generating electronic signals proportional to the residual rolling motion of said towed body; and applying power to said motor means to move said trim weight horizontally proportional to the residual rolling motion of said towed body along guide bars by a cam mechanism.

9. The method of claim 8 which further includes the step of limiting the horizontal motion using said pair of limits switches of said trim weight in response to residual rolling motion.

* * * * *